US005302785A

United States Patent [19]

Castonguay et al.

[11] Patent Number: 5,302,785

[45] Date of Patent: Apr. 12, 1994

[54] MOLDED CASE CIRCUIT BREAKER OPERATING MECHANISM CROSSBAR ASSEMBLY

[75] Inventors: Roger N. Castonguay, Terryville; David Arnold, Chester, both of Conn.

[73] Assignee: General Electric Company, New York, N.Y.

[21] Appl. No.: 33,474

[22] Filed: Mar. 18, 1993

[51] Int. Cl.[5] ..... H01H 1/22

[52] U.S. Cl. ..... 200/244; 200/401

[58] Field of Search ..... 200/244, 401, 400, 245

[56] References Cited

U.S. PATENT DOCUMENTS 3,003,046 10/1961 Torre ..... 200/401
3,134,878 5/1964 Jencks ..... 200/244
3,194,934 7/1965 Gauthier ..... 200/244
4,589,052 5/1986 Dougherty ..... 361/94
4,754,247 6/1988 Raymont et al. ..... 335/202
5,089,795 2/1992 Morgan et al. ..... 335/46

*Primary Examiner*—Ernest G. Cusick
*Assistant Examiner*—David J. Walczak
*Attorney, Agent, or Firm*—Richard A. Menelly

[57] ABSTRACT

A compact molded case circuit breaker operating mechanism crossbar assembly allows a unitary crossbar design to be used within a wide range of circuit breaker ampere ratings. A common phenolic crossbar and a metal staple are used for the higher ratings. An L-shaped filler in combination with the crossbar and staple are used to adapt the crossbar to the staple for the lower ratings.

4 Claims, 5 Drawing Sheets

MOLDED CASE CIRCUIT BREAKER OPERATING MECHANISM CROSSBAR ASSEMBLY

BACKGROUND OF THE INVENTION

Industrial-rated circuit breakers are available having operating components that are designed for automatic assembly to provide cost improvement as well as improved operating efficiency. The precision alignment performed by the automated assembly equipment allows the operating components within the circuit breaker operation mechanism to be installed within very close operating tolerances. The operating mechanism assembly includes a pair of powerful operating springs that are overcentered for rapidly driving the movable contact arm and the attached movable contact away from the stationary fixed contact to interrupt the circuit current. The operating mechanism includes a cradle operator which engages a latch assembly to prevent the movable contact arm from being driven to its open position under the urgence of the charged operating springs. The compact latch assembly includes a primary and secondary latch operating within a common support structure.

As described within U.S. Pat. No. 5,089,795,the operating mechanism includes a crossbar unit that attaches the movable contact arm to the operating mechanism assembly. A force-resistant phenolic resin material having a solid steel core is used to fabricate the crossbar that connects the individual movable contact arms within the different poles in order that the contacts within each pole are opened and closed in unison. The metal staple and the crossbar vary in size to accommodate the various circuit breaker ampere ratings.

It would be economically advantageous to have a common-sized crossbar assembly that will accommodate a large range of circuit breaker ampere ratings and facilitate the assembly of the circuit breaker operating components.

One purpose of the invention is to provide a common crossbar assembly capable of being used within a large range of circuit breaker ampere ratings without deterring from the automatic assembly of the circuit breaker operating mechanism components.

SUMMARY OF THE INVENTION

A common crossbar assembly allows the use of a standard size crossbar to be used over a wide range of circuit breaker ratings. To facilitate the use of a standard staple and movable contact arm carrier, an L-shaped insert is positioned on the crossbar prior to insertion of the crossbar within the staple.

DESCRIPTION OF THE PREFERRED EMBODIMENT

Figure 1:
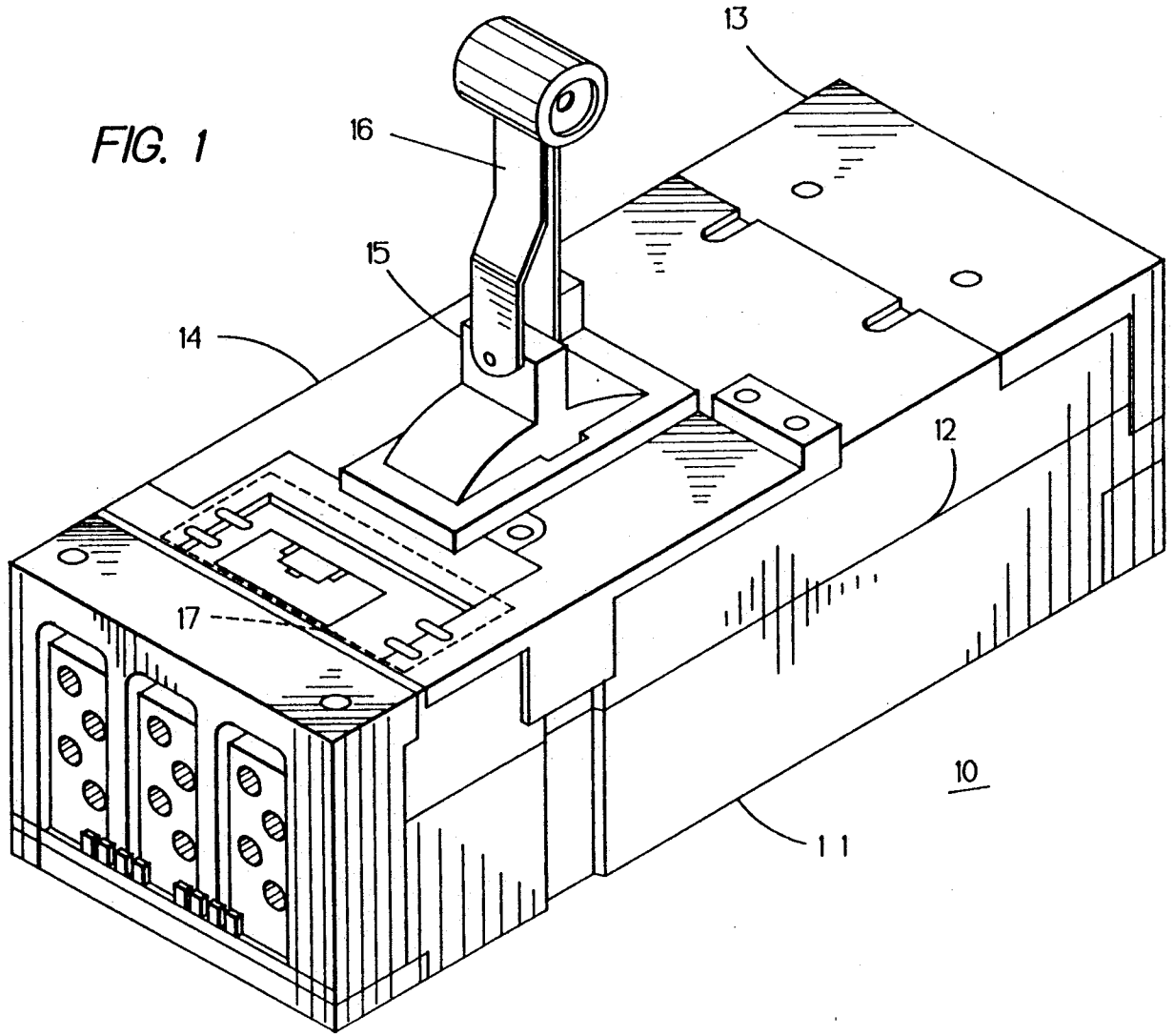
FIG. 1 is a top perspective view of a molded case circuit breaker containing the crossbar assembly of the invention.

A compact circuit interrupter 10 is depicted in FIG. 1 and consists of a molded plastic case 11 to which a molded plastic cover 12 is securely fastened. An accessory cover 14 such as described within U.S. Pat. No. 4,754,247 is used to provide access to the various circuit breaker accessories that are completely field-installable. An electronic trip unit 17 is also arranged within the circuit breaker cover for providing overcurrent determination as well as electronic accessory function. One such electronic trip unit is described within U.S. Pat. No. 4,589,052.

Figure 2:
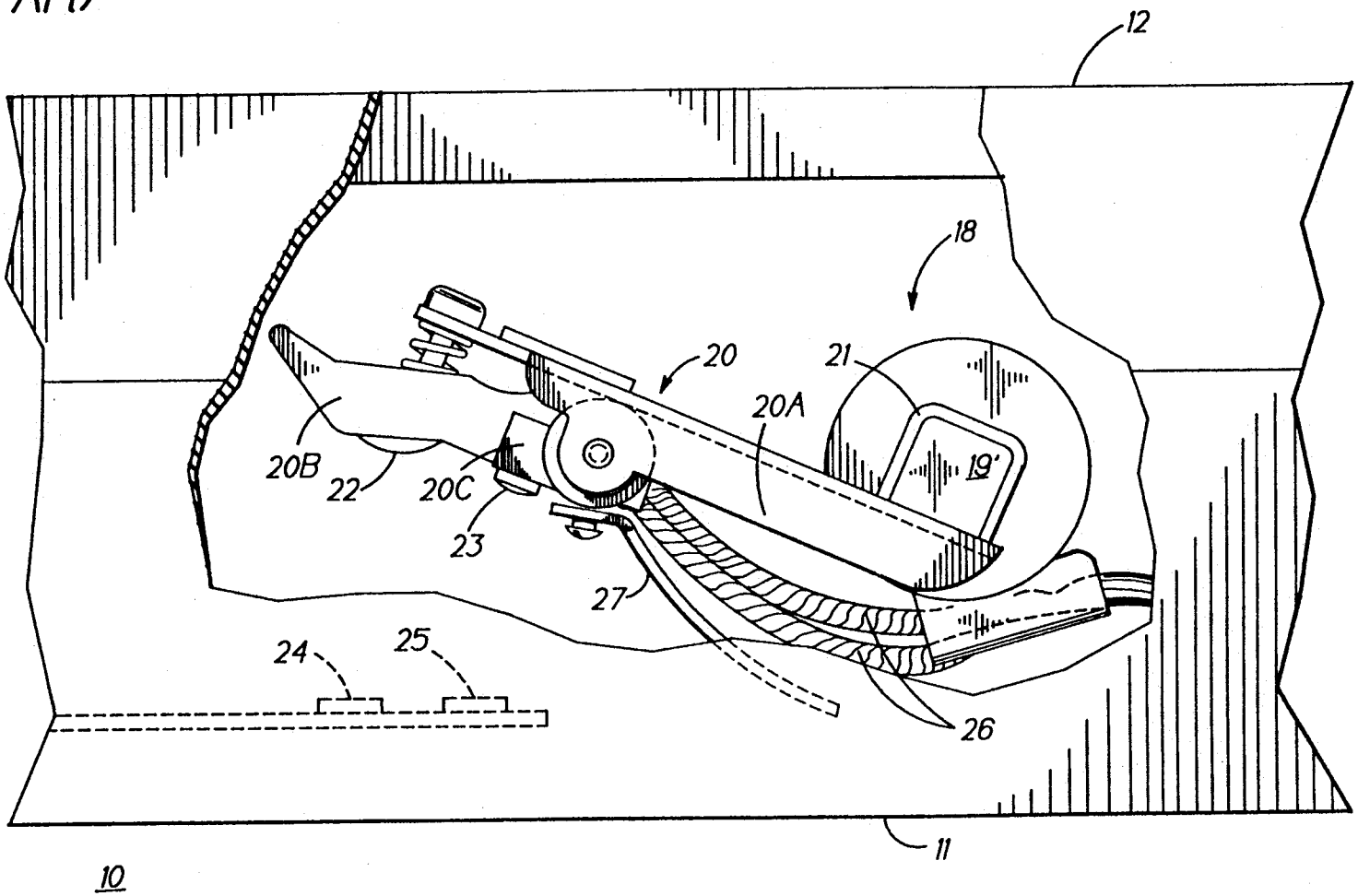
FIG. 2 (Prior Art)
FIG. 2 is an enlarged side view of the circuit breaker of FIG. 1 with part of the cover and case removed to show the movable contact arm arrangement according to the prior art.

The compact circuit breaker is capable of providing circuit interruption at increased ampere ratings by the provision of a novel lug cover-exhaust chamber 13 which is arranged on the line end of the breaker proximate the incoming power cables. An operating mechanism (not shown) is used to interrupt the circuit current by the bias provided by a pair of powerful operating springs such as described in the aforementioned U.S. Pat. No. 5,089,795. The operating mechanism interacts with the circuit breaker movable contact arm by connection therewith by means of the crossbar assembly 18 within the patent which is shown in FIG. 2. The operating mechanism is also operable by means of the circuit breaker handle 15 having an extender 16 attached.

The cover 12 and case 11 are partially removed from the circuit breaker 10 to detail the crossbar 19, formed of a steel bar to which a coating of phenolic resin is applied, which is attached to the contact carrier 20A within the movable contact arm assembly 20 by means of a metal staple 21. Electric current through the circuit breaker is carried by the braid conductor 26 to the movable contact arms 20B, 20C which carry the movable contacts 22, 23 which are driven in and out of contact with a pair of corresponding fixed contacts 24, 25 by movement of the movable contact arms. The shield 27 prevents contamination of the movable contact arms and braid conductor by the gaseous byproducts of the intense arc that occurs when the contacts become separated under such overcurrent conditions. When the circuit breaker is designed for lower ampere ratings, it has heretofore been the practice to use a corresponding smaller-sized crossbar and crossbar assembly which not only adds to the components costs but also deters from automatic assembly upon common equipment.

Figure 3:
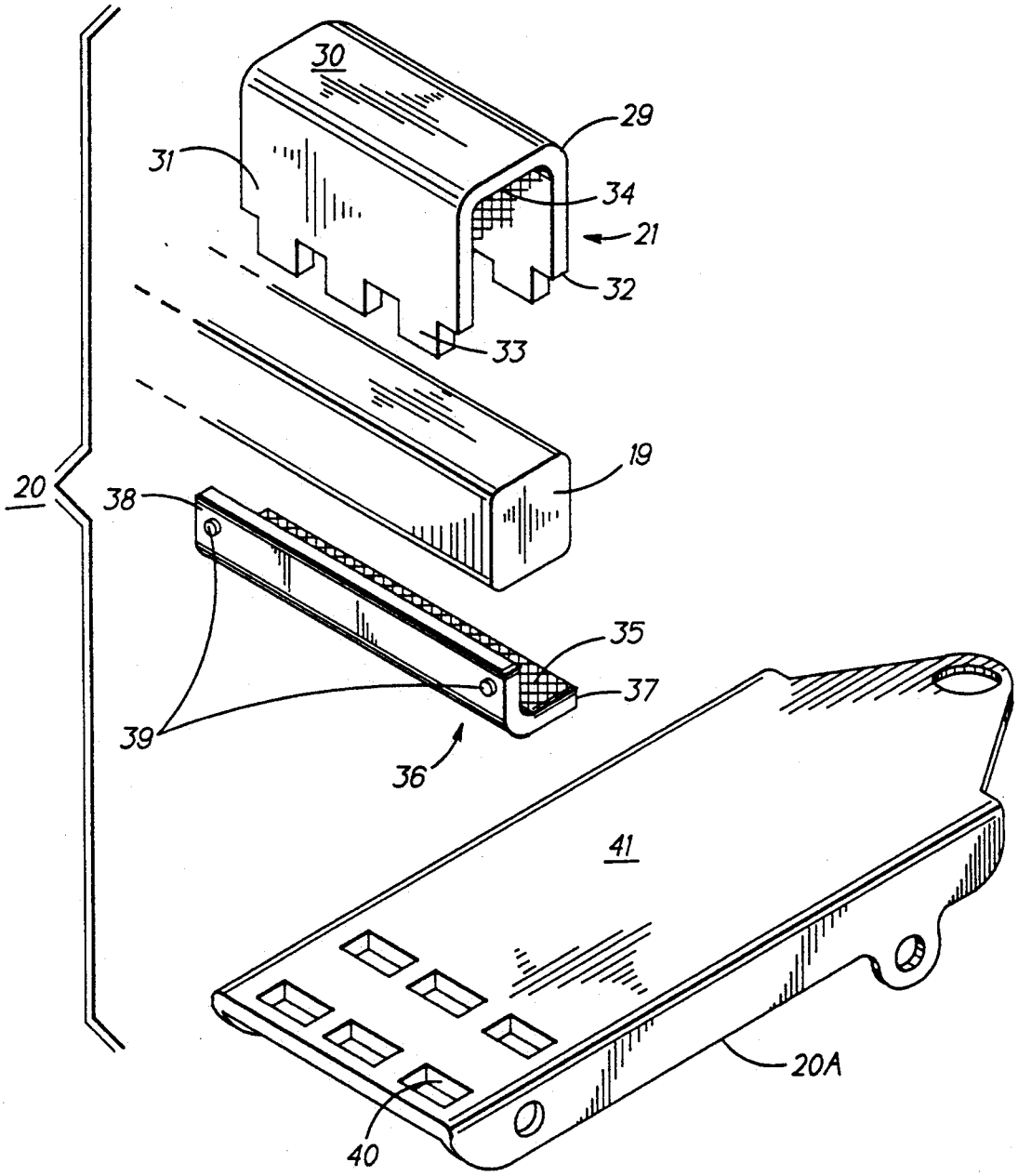
FIG. 3 is a top perspective view of the crossbar assembly within the circuit breaker of FIG. 1 with the assembly components depicted in isometric projection.

It has been determined that the crossbar used within lower-rated circuit breaker designs has sufficient strength properties to operate also within higher-rated designs such that larger more expensive crossbar components can be eliminated and common assembly equipment can now be utilized. The novel crossbar assembly arrangement is best seen by now referring to the movable contact arm assembly 20 shown in FIG. 3, wherein common reference numerals for those components within the prior art crossbar assembly depicted in FIG. 2 will be employed. The staple 21 is in the form of a U-shaped piece 29 having striations 34 formed on the upper interior surface to eliminate any transverse motion between the staple and the crossbar 19. The opposing sidearms 31, 32 depending from the bight 30 terminate in tabs 33 which are received within corresponding slots 40 formed within the top 41 of the movable contact arm carrier 20A as will be described below in greater detail. The L-shaped adapter piece 36 has a bottom piece 37 upon which striations 35 are formed which cooperate with the top striations 34 to prevent lateral motion between the crossbar and the staple. To prevent relative motion between the adapter and the staple, a pair of projections 39 are integrally-formed on the top edges of the back piece 38 which trap the edges of the sidearms of the staple in the manner to be described below. The adapter is first fitted under the crossbar before trapping the crossbar between the staple and the top of the movable contact arm carrier. The tabs 33 are inserted within the slots 40 and the tabs are then turned over against the bottom surface of the movable contact arm carrier as best seen by referring collectively to FIGS. 4 and 5.

Figure 4:
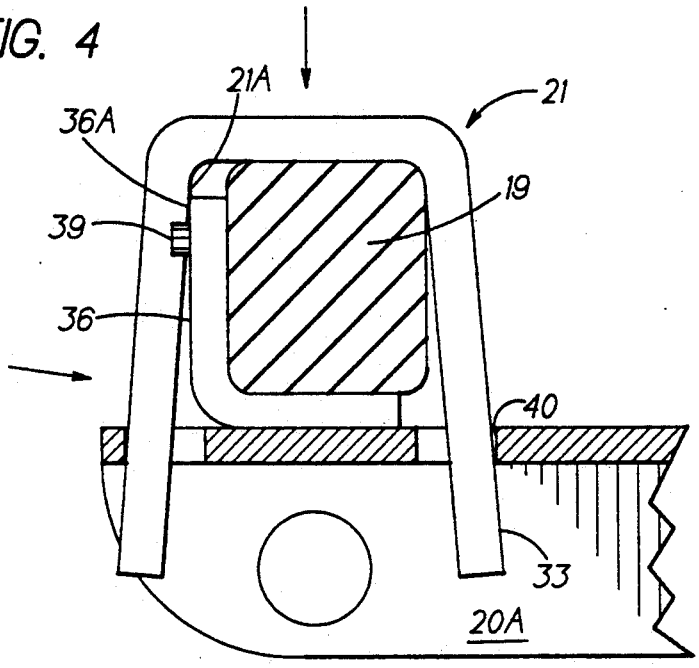
FIGS. 4 and 5 are enlarged cross-sectional representations of the completed crossbar assembly of FIG. 3.
Figure 5:
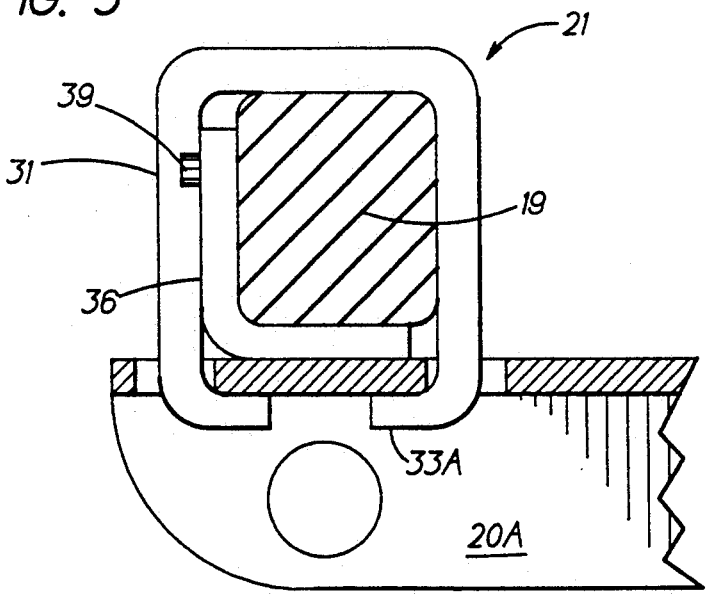

In FIG. 4, The staple 21 is depicted with the crossbar 19 and adapter 36 trapped under the staple but before pressing the tabs 33 extending through the slots 40 up against the bottom of the movable contact arm carrier 20A. It is noted that the top corner 36A of the adapter interferes with the inner part 21A of the staple 21. A pair of forces exerted in the downward and sideward direction as indicated by arrows drives the staple against the adapter, crossbar and movable contact arm carrier such that when the tabs 33 are formed over and pressed against the movable contact arm as indicated at 33A, the crossbar is rigidly held in the exact position indicated in FIG. 5 with the projections 39 abutted against the sidearms 31.

Figure 6:
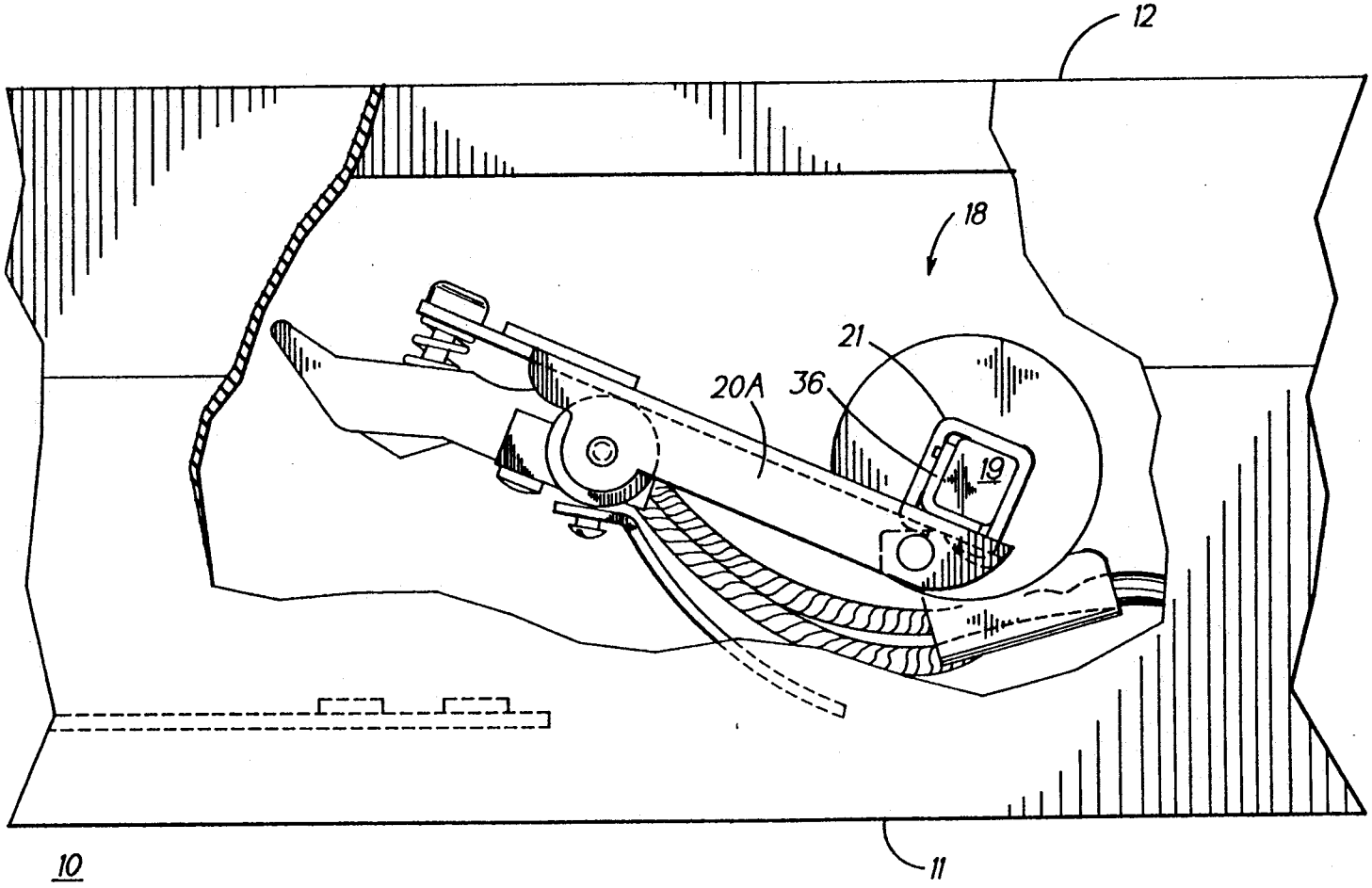
FIG. 6 is an enlarged side view of the circuit breaker of FIG. 1 with part of the cover and case removed to show the movable contact arm arrangement according to the invention.

The circuit breaker 10 is shown in FIG. 6 with a part of the cover 12 and case 11 removed to depict the crossbar 19 and adapter 36 tightly-held within the staple 21 on the movable contact arm carrier 20A in the same manner as that shown in FIG. 2 to show the commonality of the components used within both crossbar assemblies 18.

Having thus described our invention, what we claim as new and desire to secure by Letters Patent is:

1. A molded case circuit breaker movable contact arm assembly comprising:

a movable contact arm carrier supporting at least one movable contact arm having a movable contact on a bottom surface;

a U-shaped metal staple attached to a top surface of said movable contact arm carrier by means of tabs extending from said staple and slots formed within said movable contact arm carrier;

a rectangular crossbar trapped between said staple and said movable contact arm carrier;

an adapter piece supporting a part of said crossbar and being trapped between said crossbar and a part of said staple whereby said adapter and said crossbar conform to an inner surface defined within said staple; and a pair of projections extending from said adapter and trapping one side of said staple there between to prevent relative motion between said staple and said adapter.

2. The molded case circuit breaker of claim 1 wherein said crossbar comprises a metal bar coated with a phenolic resin.

3. The molded case circuit breaker of claim 1 wherein said adapter includes striations formed on a surface thereof to prevent relative motion between said crossbar and said adapter.

4. The molded case circuit breaker of claim 1 wherein said staple includes striations formed on an inner surface thereof to prevent relative motion between said staple and said crossbar.

* * * * *